US007117833B2

(12) United States Patent
Spath et al.

(10) Patent No.: US 7,117,833 B2
(45) Date of Patent: Oct. 10, 2006

(54) READILY-FILLABLE HYDRAULIC VALVE LIFTER ASSEMBLY

(75) Inventors: Mark J. Spath, Spencerport, NY (US); Daniel F. Smith, Conesus, NY (US); Thomas H. Lichti, Victor, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/977,071

(22) Filed: Oct. 29, 2004

(65) Prior Publication Data

US 2006/0090720 A1 May 4, 2006

(51) Int. Cl.
*F01L 1/14* (2006.01)

(52) U.S. Cl. ..... 123/90.55; 123/90.16; 123/90.48; 123/90.57

(58) Field of Classification Search ..... 123/90.53, 123/90.57, 90.58, 90.55, 90.52, 90.48, 90.49, 123/90.16
See application file for complete search history.

(56) References Cited

U.S. PATENT DOCUMENTS 4,457,270 A * 7/1984 Kodama et al. ..... 123/90.58
4,463,714 A * 8/1984 Nakamura ..... 123/90.57
6,247,433 B1 * 6/2001 Faria et al. ..... 123/90.16
6,578,535 B1 6/2003 Spath et al.
6,595,174 B1 7/2003 Schnell
6,606,972 B1 8/2003 Wenisch et al.
2005/0056246 A1 3/2005 Itoafa

* cited by examiner

*Primary Examiner*—Thomas Denion
*Assistant Examiner*—Zelalem Eshete
(74) *Attorney, Agent, or Firm*—Paul L. Marshall

(57) ABSTRACT

A hydraulic valve lifter including venting means to assure venting of air through the lifter and filling thereof with oil during pre-start filling of the engine oil galleries after engine assembly. Patterning of a hemispherical pushrod seat surface, and/or patterning of either or both of the mating surfaces of a pushrod seat and a piston, permits air purged from the engine through a pushrod to be vented through the lifter. Such means may be temporary or permanent and may include coatings of the surfaces with materials that are destroyed by engine action after starting. Permanent means may include surface grooves in the mating surfaces and/or small-diameter passages between the hemispherical seat surface and the cylindrical outer surface of the pushrod seat. Venting means in accordance with the invention is useful for both valve-deactivating and non-valve-deactivating valve lifters.

12 Claims, 4 Drawing Sheets

READILY-FILLABLE HYDRAULIC VALVE LIFTER ASSEMBLY

TECHNICAL FIELD

The present invention relates to hydraulic lifters for activating valves in response to rotation of a camshaft in an internal combustion engine; more particularly, to such lifters supplied with oil during operation through a hollow valve pushrod; and most particularly, to such a hydraulic valve lifter assembly wherein venting is provided in the lifter mechanism to permit easy displacement of air that accumulates in the pushrod and lifter mechanism during manufacture of an internal combustion engine.

BACKGROUND OF THE INVENTION

Hydraulic lifter assemblies for actuating intake and exhaust valves in internal combustion engines are well known. A typical lifter assembly includes a lifter body supportive of cam follower such as a roller. In use, the body is disposed for reciprocal motion in a bore in an engine block for translating rotary motion of a cam lobe into reciprocal motion of a pushrod. A piston within a well in the lifter body defines a high-pressure chamber in the well between the piston and the bottom of the well. The piston includes a low-pressure reservoir supplied with engine oil, from which the high-pressure chamber is replenished via a check valve. A pushrod seat closes the low-pressure chamber and receives the pushrod. A spring within the high-pressure chamber urges the piston outwards, thus removing mechanical lash in the valve train. The low-pressure chamber is provided with oil via an axial passage in the pushrod in communication with an oil gallery in the engine rocker arm assembly, such that there are no air voids in the oil supply system during engine operation.

It is necessary to completely purge air from an engine oil supply system after assembly of the engine and before the first starting. Of necessity, when the rocker arm assembly is bolted to the engine head, some of the intake and exhaust valves are placed in an open position. In a relatively short time, those lifter assemblies associated with the open valves will leak oil from their high-pressure chambers in response to force exerted by the valve springs. When this happens during normal operation of an engine, as during periods of inoperation, it is of little consequence, as the lifter automatically refills from the low-pressure reservoir through the check valve as soon as the engine is re-started and the force is relieved from the lifter. However, upon first starting an engine after assembly, it is essential that the low-pressure reservoir have sufficient oil to refill the high-pressure chamber immediately. A failure to provide oil for filling of the high-pressure chamber immediately results in a noisy lifter, a false indication of lifter failure, a failure of the first-start-after-assembly engine test, and substantial engine rework costs.

To guard against this problem in the prior art, lifters are carefully filled with oil after assembly of the lifter and are shipped in a vertical position. However, engine assembly can require a lifter to be placed in an orientation wherein oil can drain from the lifter. In addition, some engines have normal lifter positions wherein oil can drain from the low-pressure reservoir during and after engine assembly.

Prior to starting a newly-assembled engine, oil is forced through the oil distribution system under pressure for a predetermined time period, typically on the order of one minute, to purge air from the system. A large amount of air is initially present in galleries in the rocker arm shaft, rocker arms, and pushrods, which air must be expelled from the pushrods at or through the hydraulic valve lifters. Because there is no lash between elements in the valve-open valve trains, air purging is difficult and frequently incomplete, resulting in a noisy lifter upon initial starting. Further, any lifter with residual air trapped in the low-pressure reservoir may suck that air into the high-pressure chamber upon start-up, producing a void therein resulting in prolonged lifter noise and test failure.

What is needed in the art of hydraulic valve lifters is a means to assure purging of air from all engine pushrods and lifters prior to first starting of an engine.

It is a principal object of the present invention to prevent lifter test failure of a newly-assembled internal combustion engine.

SUMMARY OF THE INVENTION

Briefly described, in a hydraulic valve lifter assembly in accordance with the invention, wherein air is introduced into the lifter through an associated pushrod during pre-start filling of the engine oil galleries prior to first start after engine assembly, means is included in the lifter to assure venting of the air out of the lifter. Such means may include, but is not limited to, patterning of the hemispherical pushrod seat surface, and patterning of either or both of the mating surfaces of the pushrod seat and the piston. Preferably, such patterning is sufficiently deep to permit easy venting of air but sufficiently shallow to prevent easy leakage of oil through the same flow path. Further, such means may be temporary or permanent. Temporary means may include coatings of the above-mentioned surfaces with materials such as waxes, inks, and the like that are readily destroyed by engine action after starting and that leave innocuous residues. Permanent means may include surface grooves in the mating surfaces and/or small-diameter passages venting the area of the low pressure chamber of the lifter to the cylindrical outer surface of the pushrod seat.

Venting means in accordance with the invention is useful for both valve-deactivating and non-valve-deactivating valve lifters.

BRIEF DESCRIPTION OF THE DRAWINGS

The present invention will now be described, by way of example, with reference to the accompanying drawings, in which.

DESCRIPTION OF THE PREFERRED EMBODIMENTS

Figure 2:
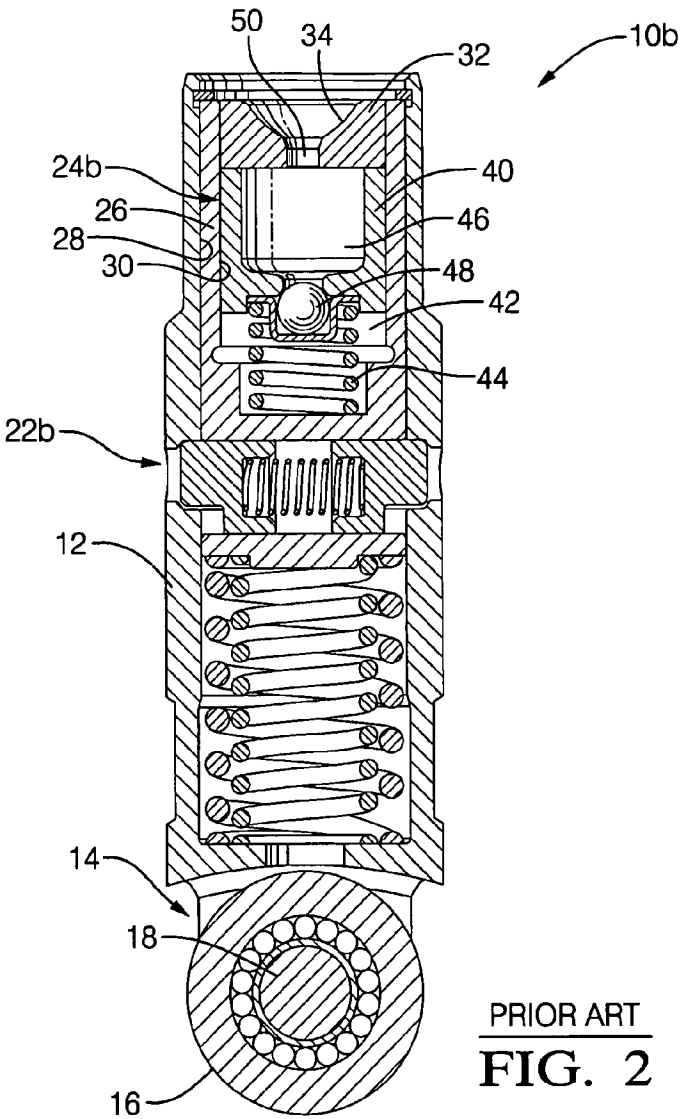
PRIOR ART FIG. 2
FIG. 2 is an elevational cross-sectional view of a first prior art valve-deactivating lifter assembly.
Figure 1:
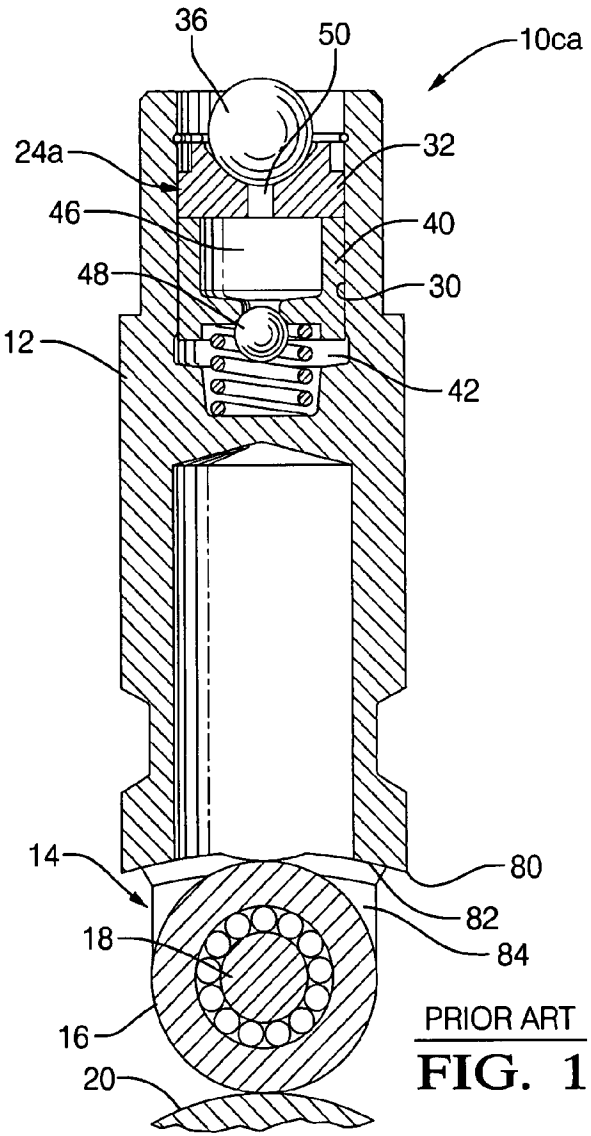
PRIOR ART FIG. 1
FIG. 1 is an elevational cross-sectional view of a prior art non-valve-deactivating hydraulic lifter assembly.

Referring to FIGS. 1 through 4, prior art hydraulic valve lifter assemblies 10*a*,10*b*,10*c*,10*d*, respectively, for moving reciprocally in a bore 11 to actuate a valve (not shown) in an internal combustion engine 13 comprise a generally cylindrical lifter body 12 supporting at a lower end 14 a cam follower roller 16 rotatably attached to body 12 by an axle 18 for following a cam lobe 20.

Lifter assembly 10*a* is substantially identical to non-valve-deactivating hydraulic valve lifter assemblies, as are well known in the prior art of internal combustion engines.

Lifter assembly 10*b* is a valve-deactivating lifter assembly substantially as disclosed in U.S. Pat. No. 6,595,174 issued Jul. 22, 2003 to Schnell.

Lifter assembly 10*c* is a valve-deactivating lifter assembly substantially as disclosed in U.S. Pat. No. 6,606,972 issued Aug. 19, 2003 to Wenisch et al.

Lifter assembly 10*d* is a valve-deactivating lifter assembly substantially as disclosed in U.S. Pat. No. 6,578,535 issued Jun. 17, 2003 to Spath et al., the relevant disclosure of which is incorporated herein by reference.

Lifter assemblies 10*b*,10*c*,10*d* differ significantly from lifter assembly 10*a* only in their respective deactivating mechanisms 22*b*,22*c*,22*d* which are not immediately relevant to the present invention and need not be discussed in detail further. The purpose in showing a prior art non-valve-deactivating lifter assembly 10*a* along with three representative prior art valve-deactivating lifter assemblies 10*b*,10*c*, 10*d* is to show that the upper end hydraulic valve lifter means 24*a*,24*b*,24*c*,24*d* is substantially identical, functionally, in both non-valve-deactivating and valve-deactivating prior art lifter assemblies. As is shown below, the invention is useful when incorporated into either type of hydraulic valve lifter assembly.

Figure 4:
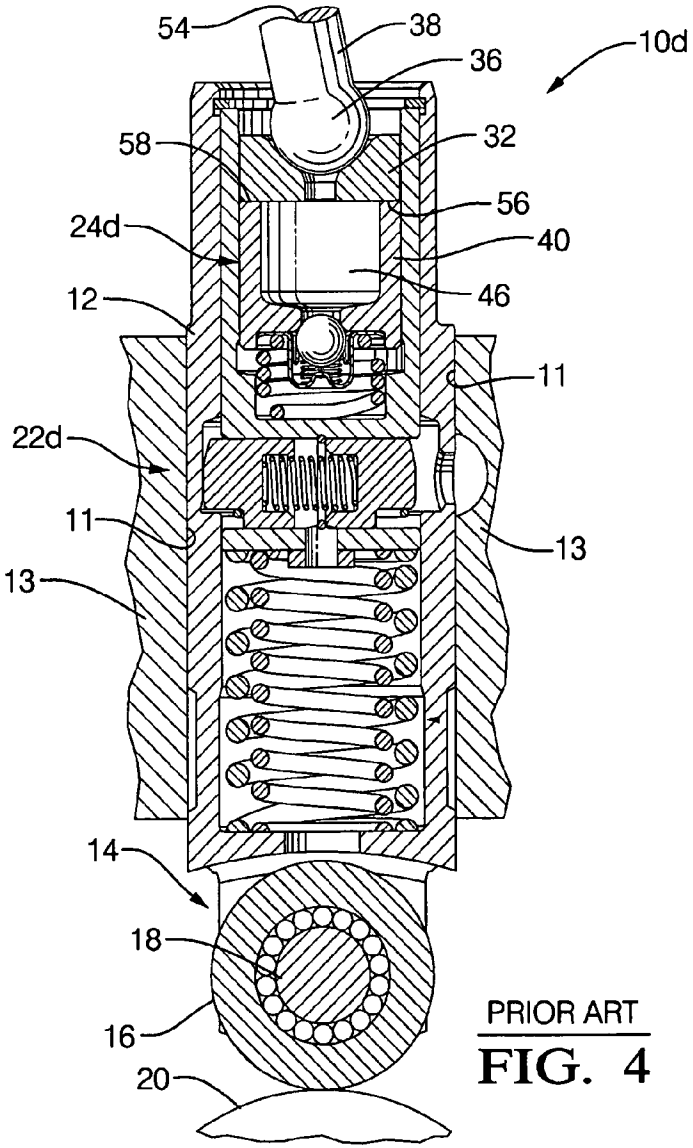
PRIOR ART FIG. 4
FIG. 4 is an elevational cross-sectional view of a third prior art valve-deactivating lifter assembly.
Figure 3:
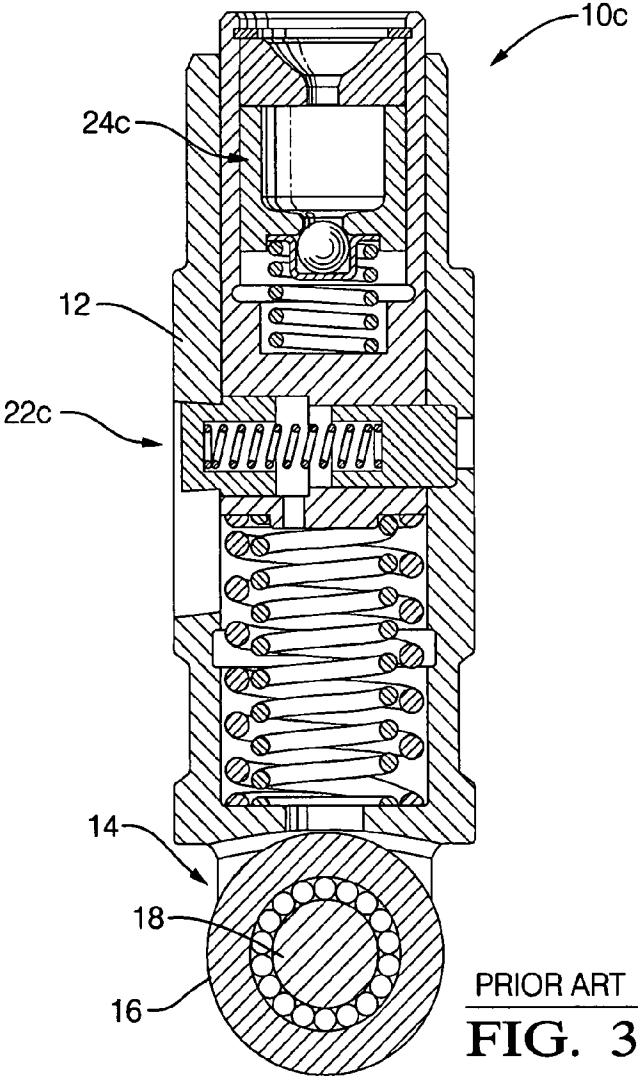
PRIOR ART FIG. 3
FIG. 3 is an elevational cross-sectional view of a second prior art valve-deactivating lifter assembly.
Figure 7:
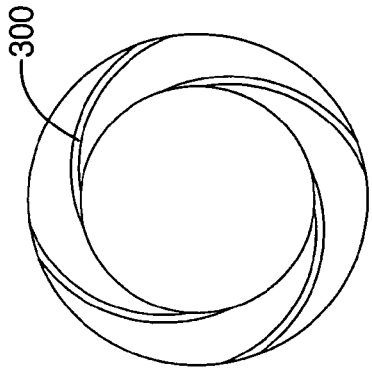
FIGS. 6 through 12 are plan views of the mating surfaces of the push rod socket, piston and/or, seat, showing seven exemplary surface patternings in accordance with the invention.
Figure 9:
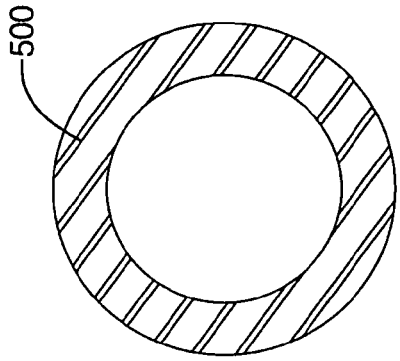
Figure 6:
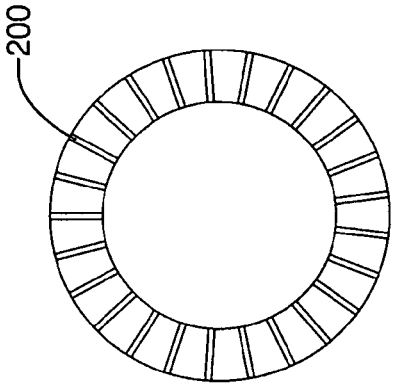
Figure 8:
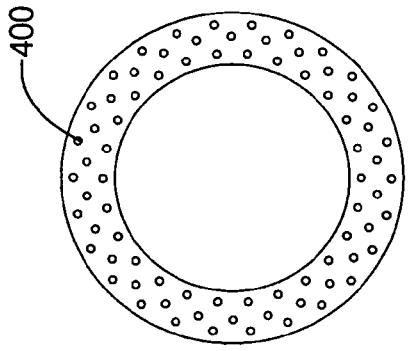
Figure 5:
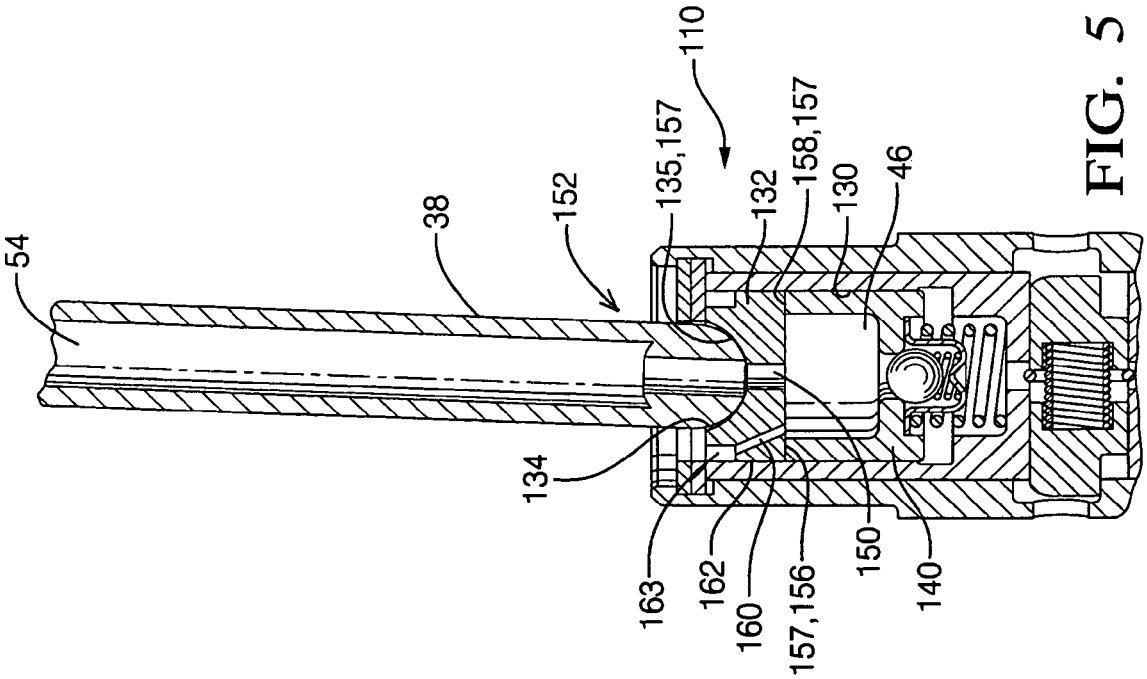
FIG. 5 is a detailed elevational cross-sectional view of the upper end of the lifter assembly shown in FIG. 4, showing modifications thereto in accordance with the invention.

Referring to FIGS. 2 through 4, in a valve-deactivating lifter assembly, a pin housing 26 is slidably disposed within a first axial bore 28 in lifter body 12. Pin housing 26 itself has a second axial bore 30 for receiving a conventional hydraulic lash adjuster (HLA) mechanism generally designated 24 which may be of a type well known to those skilled in the art. HLA 24 includes a pushrod seat 32 having a spherical socket surface 34 for receiving a ball end 36 of a conventional engine valve pushrod 38. HLA 24 further includes a piston 40 slidably disposed in bore 30 and defining a high-pressure chamber 42 containing a lash elimination spring 44. A bottom surface of piston 40 defines, in part, a low-pressure reservoir 46 communicating with high-pressure chamber 42 via a check valve 48. Reservoir 46 is in fluid communication with and therefore is supplied with engine oil by passage 50 through pushrod seat 32 and supply passage 54 within pushrod 38. Reservoir 46 is closed by an interface between first and second mating surfaces 56,58 of seat 32 and piston 40, respectively.

The HLA 24 as just described is common (24*a*,24*b*,24*c*, 24*d*) to all four exemplary lifter assemblies 10*a*,10*b*,10*c*, 10*d*.

Referring to FIGS. 5 through 9, in a hydraulic valve lifter 110 a first embodiment of venting means 152 in accordance with the invention comprises seat 132 having socket 134, including socket surface 135 and/or first mating surface 156 and/or second mating surface 158 between the seat and socket, modified to provide a relief patterning to permit passage of air between pushrod ball end 36 and socket surface 135 and/or between first and second mating surfaces 156,158. The relief patterning may take the form of a sacrificial layer 157, formed, for example, of a heavy ink, wax, or other suitable polymer and featured with grooves or other features that serve to controllably disrupt the sealability of mating surfaces 156/158 and/or socket surface 135 to permit passage of air across the surface thereof. The layer may be applied by conventional means such as spraying, dipping, and the like. Being sacrificial, the layer is competent to readily vent air being purged from the engine oil galleries during initial engine start-up after assembly, permitting the topping up with engine oil of the low-pressure reservoir 46, but is rapidly destroyed and flushed away during engine operation when such venting is no longer necessary.

Figure 11:
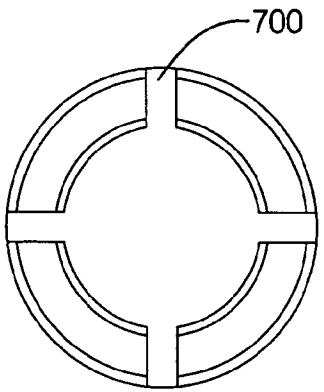
Figure 10:
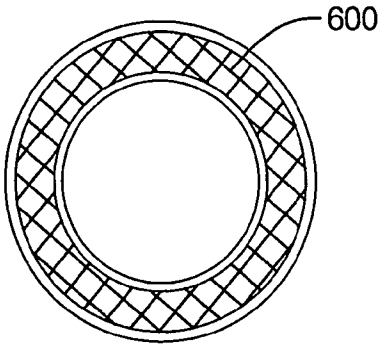
Figure 12:
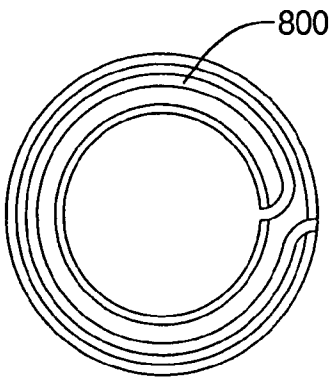

The relief patterning may also take the form of permanent patterns formed in socket surface 135 and/or mating surfaces 156,158. Some exemplary patterns, which may be either temporary or permanent, are offered in FIGS. 6 through 12: radial grooves 200 (FIG. 6); spiral grooves 300 (FIG. 7); random roughness 400 (FIG. 8); parallel grooves 500 (FIG. 9); cross-hatched grooves 600 (FIG. 10); and radial quadrant grooves 700 (FIG. 11). FIG. 12 shows one continuous spiral groove 800 formed in the face of the surface beginning at an inside edge and proceeding outward in an increasing radius spiral to its terminus approximately adjacent its beginning point at an outside edge.

The patterns shown herein are only exemplary; obviously, other patterns as may be conceived of by one of ordinary skill in the art are fully comprehended by the invention. Further, as may be determined by one of ordinary skill in the art without undue experimentation, the grooves or roughness should be sized in dimension and number to permit ready venting of air during purging thereof from the engine galleries but to inhibit significant passage of engine oil during normal operation of the lifter.

When air is vented across socket surface 135, in accordance with the invention, air escapes generally into the engine cavity via the top of assembly 110. When air is vented across either surface 156 or surface 158, in accordance with the invention, air escapes generally into the engine cavity via vent space 162 formed in bore 130 between seat 132 and the pin housing (shown as 26 in FIG. 2), or an analogous space in a non-deactivating lifter assembly such as 10*a*.

Referring again to FIG. 5, in a second embodiment of venting means in accordance with the invention, one or more vent passages 160, and preferably a plurality, are provided in pushrod seat 132, in a generally radial direction through seat 132 to recess 163, thereby venting trapped air from push rod supply passage 54, seat passage 150, and/or reservoir 46 to recess 163. As described above for the grooves and roughness, passages 160 should be sized in dimension and number to permit ready venting of air during purging thereof from the engine galleries but to inhibit significant passage of engine oil during normal operation of the lifter. Also, while this embodiment, as shown, provides venting of trapped air from the head space above low pressure reservoir 46 to seat recess 163, it is understood that vent passages 160 may be disposed to provide a path for the venting of air to the outside of the lifter assembly from within push rod 38, seat 132 or low pressure reservoir 46. For example, within the scope of this invention, passages 160 may connect seat passage 150 to vent space 162.

Figure 14:
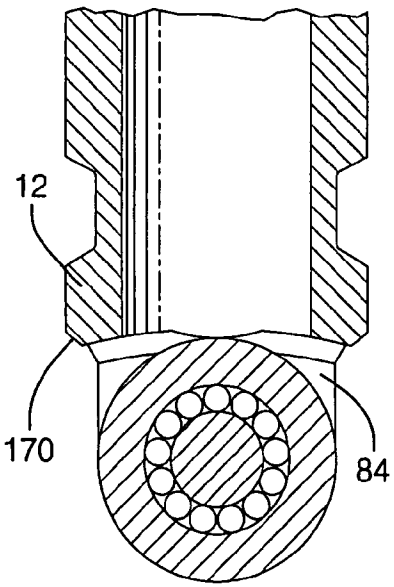
FIG. 14 is an elevational cross-sectional view of the lifter shown in FIG. 13, taken along line 14—14 therein.
Figure 13:
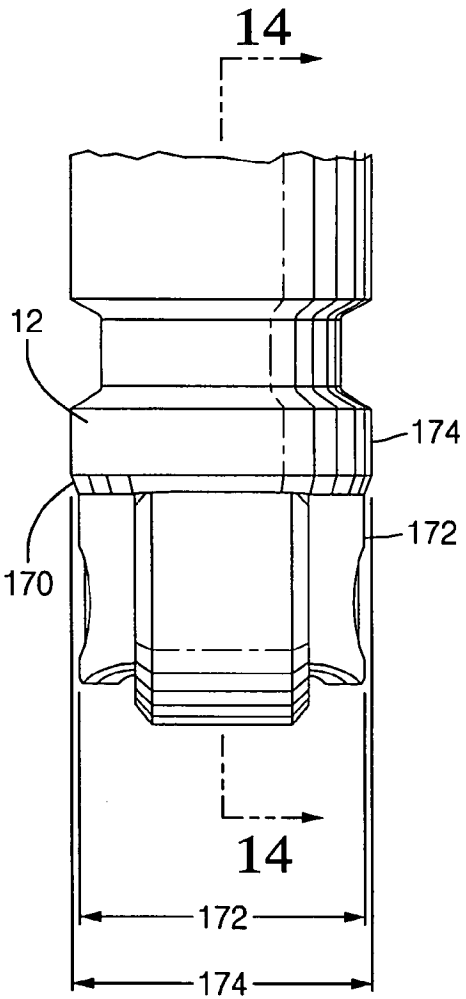
FIG. 13 is an elevational view of a lower end of a lifter assembly in accordance with the invention, showing a reduced diameter portion to reduce chafing and galling in an associated engine bore.

Referring to FIGS. 13 and 14, an HLA in accordance with the invention preferably includes an additional improvement comprising a chamfered relief 170 and reduced body diameter 172 with respect to main body diameter 174. A known problem in the prior art is a burr 80 (FIG. 1) at lower edge 82 formed when machining body 12 to form wheel groove 84. If not removed, burr 80 is known to cause undesirable scratching and wear of the surface of bore 11 during use. In the prior art, burr 80 typically is removed in a separate deburring operation, adding to the cost of manufacture of a prior art HLA.

A less expensive solution to the problem is to add chamfered relief 170 and reduced body diameter as part of the machining operation of the outer surfaces of body 12, adding little if any cost to manufacture. Thus, when wheel groove 84 is cut, any residual burr is contained within the reduced diameter portion, cannot interface with bore surface 11, and need not be removed.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A hydraulic valve lifter assembly, comprising:

a) a lifter body;

b) a piston disposed in said body and defining a high-pressure chamber at a first side thereof and a low-pressure chamber at a second side thereof, said high-pressure and low-pressure chambers communicating via a check valve; and c) a pushrod seat disposed in said body adjacent said piston and having a socket for receiving an end of an engine pushrod, wherein said lifter assembly includes a plurality of internal surfaces on said piston and said pushrod seat, and wherein at least one of said surfaces is provided with relief patterning to permit venting of air from said lifter assembly across said surface.

2. A hydraulic valve lifter assembly in accordance with claim 1, wherein a surface having said relief patterning is a surface of said socket.

3. A hydraulic valve lifter assembly in accordance with claim 1 wherein said pushrod seat includes an axial surface and wherein said piston includes an axial surface, and wherein at least one of said pushrod seat surface and said piston surface includes said relief patterning.

4. A lifter assembly in accordance with claim 1 wherein said relief patterning is selected from the group consisting of temporary and permanent.

5. A lifter assembly in accordance with claim 4 wherein said relief patterning is selected from the group consisting of radial grooves, spiral grooves, parallel grooves, and random roughness.

6. A lifter assembly in accordance with claim 4 wherein said temporary relief patterning includes a sacrificial layer.

7. A lifter assembly in accordance with claim 6 wherein said layer includes a material selected from the group consisting of inks, wax, polymers, and combinations thereof.

8. A hydraulic valve lifter assembly in accordance with claim 1 wherein said assembly is a non-valve-deactivating assembly.

9. A hydraulic valve lifter assembly in accordance with claim 1 wherein said assembly is a valve-deactivating assembly.

10. A hydraulic valve lifter assembly, comprising:

a) a lifter body;

b) a piston disposed in said body and defining a high-pressure chamber at a first side thereof and a low-pressure chamber at a second side thereof, said high-pressure and low-pressure chambers communicating via a check valve; and c) a pushrod seat disposed in said body adjacent said piston, said seat having a socket for receiving an end of an engine pushrod, having a connecting passage extending between said socket and said low-pressure chamber, and having at least one venting passage, wherein said at least one venting passage is in communication between the exterior of said seat and said socket and said connecting passage and said low-pressure chamber.

11. A hydraulic valve lifter assembly in accordance with claim 10, wherein an end of said venting passage is in communication with a seat recess.

12. An internal combustion engine comprising a hydraulic valve lifter including a lifter body, a piston disposed in said body and defining a high-pressure chamber at a first side thereof and a low-pressure chamber at a second side thereof, said high-pressure and low-pressure chambers communicating via a check valve, and a pushrod seat disposed in said body adjacent said piston and having a socket for receiving an end of an engine pushrod, wherein said lifter assembly includes a plurality of internal surfaces on said piston and said pushrod seat, and wherein at least one of said surfaces is provided with relief patterning to permit venting of air from said lifter assembly across said surface.

* * * * *